US008096827B2

(12) United States Patent
Kleinkorres

(10) Patent No.: US 8,096,827 B2
(45) Date of Patent: Jan. 17, 2012

(54) DISTRIBUTOR SYSTEM AND METHOD FOR ITS PRODUCTION

(75) Inventor: Uwe Kleinkorres, Wetter (DE)

(73) Assignee: Escha Bauelemente GmbH, Halver (DE)

( * ) Notice: Subject to any disclaimer, the term of this patent is extended or adjusted under 35 U.S.C. 154(b) by 0 days.

(21) Appl. No.: 12/295,741

(22) PCT Filed: Mar. 27, 2007

(86) PCT No.: PCT/EP2007/002692

§ 371 (c)(1),
(2), (4) Date: Oct. 2, 2008

(87) PCT Pub. No.: WO2007/115682

PCT Pub. Date: Oct. 18, 2007

(65) Prior Publication Data

US 2009/0176405 A1 Jul. 9, 2009

(30) Foreign Application Priority Data

Apr. 4, 2006 (DE) ..... 10 2006 015 718

(51) Int. Cl.
*H01R 13/60* (2006.01)
*H01R 13/66* (2006.01)

(52) U.S. Cl. ..... 439/540.1; 439/954

(58) Field of Classification Search ..... 439/544–549, 439/680, 552, 553, 565, 540.1, 954, 557, 439/569

See application file for complete search history.

(56) References Cited

U.S. PATENT DOCUMENTS

| | | | | |
|---|---|---|---|---|
| 4,220,808 | A * | 9/1980 | Fujita | 174/490 |
| 4,731,925 | A * | 3/1988 | Tanishi et al. | 29/840 |
| 5,007,862 | A * | 4/1991 | Defibaugh et al. | 439/607.59 |
| 5,263,871 | A * | 11/1993 | Sano | 439/157 |
| 6,394,814 | B2 * | 5/2002 | Schmid et al. | 439/550 |
| 6,394,856 | B1 * | 5/2002 | Wertz | 439/681 |
| 6,585,539 | B2 | 7/2003 | Ishikawa | |

(Continued)

FOREIGN PATENT DOCUMENTS

DE G9313896.2 U1 9/1993

(Continued)

OTHER PUBLICATIONS

English Translation of International Preliminary Report on Patentability and Written Opinion from International Application No. PCT/EP2007/002692, issued on Nov. 17, 2008.

*Primary Examiner* — Javaid Nasri
(74) *Attorney, Agent, or Firm* — Kevin P. Radigan, Esq.; Heslin Rothenberg Farley & Mesiti P.C.

(57) ABSTRACT

The invention relates to a distributor system including a support device and a plurality of contact supports which are arranged in the support device, the support device having at least one holding device in which at least one of the contact supports is held by a holding section fitting into the holding device. The invention also relates to a method for the production of a distributor system including a support device and a plurality of contact supports which are arranged in the support device, including the following steps: provision of a support device having at least one holding device, provision of at least one contact support having a holding section fitting into the holding device, and insertion of the contact support into the holding device.

44 Claims, 8 Drawing Sheets

U.S. PATENT DOCUMENTS

| | | | | |
|---|---|---|---|---|
| 6,679,726 | B1 | 1/2004 | Tunn et al. | |
| 2001/0021607 | A1 | 9/2001 | Schmid et al. | |
| 2002/0182942 | A1 * | 12/2002 | Lieb et al. | 439/717 |
| 2008/0166916 | A1 | 7/2008 | Busse | |

FOREIGN PATENT DOCUMENTS

| | | | |
|---|---|---|---|
| DE | 197 32 662 | A1 | 2/1999 |
| DE | 198 01 260 | A1 | 7/1999 |
| DE | 200 04 054 | U1 | 3/2000 |
| DE | 101 27 504 | | 12/2002 |
| DE | 102005009588 | A1 | 9/2005 |
| DE | 10 2004 042586 | B3 | 12/2005 |
| EP | 1241 741 | A1 | 3/2001 |
| EP | 1 134 850 | B1 | 7/2004 |

* cited by examiner

DISTRIBUTOR SYSTEM AND METHOD FOR ITS PRODUCTION

CROSS REFERENCE TO RELATED APPLICATIONS

This application is a national stage filing under section 371 of International Application No. PCT/EP2007/002692, filed on Mar. 27, 2007, and published in German on Oct. 18, 2007, as WO 2007/115682 A1, and which claims priority of German application No. 10 2006 015 718.4, filed on Apr. 4, 2006, the entire disclosure of these applications being hereby incorporated herein by reference.

TECHNICAL FIELD

The invention relates to a distributor system comprising a support device and a plurality of contact supports arranged in the support device.

BACKGROUND OF THE INVENTION

Such distributor systems have a one-piece distributor housing. A plurality of contact supports which have a fixed coding with regard to both the type and the orientation are formed in a plate. The plate is produced by means of an injection mould which establishes the type and orientation of the coding of the contact supports.

These known distributor systems have the disadvantage that a new injection mould has to be produced each time if another type or orientation of at least one contact support integrated in the plate is desired. This is associated with considerable costs. Moreover, a lead time is always required for producing the changed distributor system because a new injection mould is required.

SUMMARY OF THE INVENTION

It is therefore an object of the invention to provide a distributor system which can be produced rapidly and economically in various configurations, and to provide a method for the production of distributor systems which can be configured in various ways.

An object of the invention is achieved by a distributor system according to features of the claims presented herein. Advantageous developments of the invention are stated in the dependent claims.

According to one embodiment of the invention, a distributor system has a support device and a plurality of contact supports which are arranged in the support device. The support device having at least one holding device in which at least one of the contact supports is held by a holding section fitting into the holding device.

This gives rise to the advantage that different contact supports can be used in order to produce differently configured distributor systems. The costs for the corresponding injection moulds are lower. Moreover, with an appropriate design (e.g. rotational symmetry), there is no need for new injection moulds because different orientations of the coding can be created with the same components. This makes it possible to cut considerable costs.

According to the invention, the support device may have a plurality of holding devices, in each of which one of the contact supports is held by a holding section fitting into the holding device. This gives rise to the advantage of greater freedom of design and the associated considerable cost cuts.

According to the invention, the at least one contact support or the contact supports may have a holding section which is held in each case in a holding device of the support device, which holding device corresponds to the holding section.

Advantageously, the holding devices may be identically formed. This has the advantage that the holding sections of different contact supports can be identically formed, which is associated with lower construction and mould costs.

Alternatively, the holding devices may also be partly differently formed, for example if certain contact support types are provided in certain positions of the support device and errors in production are to be reliably avoided.

According to the invention, the cross-section of the at least one holding device or of some or preferably all holding devices may be rotationally symmetrical. This has the advantage that the coding of the contact supports can be arranged in different orientations.

According to the invention, the at least one holding device may have a cross-section of a regular polygon, preferably of an octagon, heptagon, hexagon, pentagon, tetragon or triangle. Other shapes obvious to the person skilled in the art are conceivable.

According to the invention, the holding section arranged in the holding device may have a shape which is formed in such a way that the holding section can be arranged in different orientations. This has the advantage that the coding of the contact supports can be arranged in different orientations. It is clear that the holding device need not be rotationally symmetrical for this purpose.

According to the invention, the holding section may have a cross-section which substantially corresponds to the cross-section of the holding device coordinated with it.

According to the invention, the cross-section of the at least one holding device may be asymmetrical.

According to the invention, the cross-section of the at least one holding device can be substantially circular, and the holding device may have recesses which are distributed over the circumference and which receive preferably at least one projection or a plurality of projections of the holding section of the contact support. According to the invention, the holding section may have for this purpose at least one projection which fits into the recesses of the holding device. One projection may be sufficient because a large load is usually not exerted in the circumferential direction. In embodiments for applications with the possibility of larger loads in the circumferential direction, it is also possible to provide a plurality of projections which fit into the recesses of the holding device. For example, the number of projections may correspond to the number of recesses, the projections and recesses being arranged over the circumference, preferably with a uniform distribution.

According to the invention, the number of projections may also be smaller than the number of recesses. The recesses may then also be asymmetrically distributed over the circumference in such a way that the projection or the projections can be arranged in different orientations in the recesses.

According to the invention, the cross-section of the at least one holding device may be substantially circular, and the holding device may have at least one projection. The holding section may then have a plurality of recesses distributed over the circumference for receiving the at least one projection. Furthermore, the holding device may also have at least a plurality of projections which fit into the recesses of the holding section. The number of projections may correspond to the number of recesses, and the projections and recesses may be arranged over the circumference with a uniform distribution.

According to the invention, the number of projections may also be smaller than the number of recesses. The recesses may then also be asymmetrically distributed over the circumference in such a way that the projection or the projections can be arranged in different orientations in the recesses.

According to the invention, the holding device may form a press fit with the holding section. This has the advantage that a sealing effect can be achieved at the same time. Alternatively or additionally, the holding device may be welded, or screwed to, inserted into, interlocked with or adhesively bonded to the holding section or connected to said holding section by another joining method.

According to the invention, it is possible to provide a joining element which is arranged around the circumference of the contact support. Preferably, the joining element can secure the contact support in the holding device. Alternatively or preferably additionally, the joining element can seal the contact support in the holding device. For example, the joining element can be welded, screwed, inserted, interlocked or adhesively bonded or fastened by another joining method.

According to the invention, the joining element may have a connecting section for connecting a plug which can be plugged onto the contact support. For example, the connecting section may be designed for a thread connection, a bayonet connection, a push/pull connection and/or a quick-release connection. It is also possible to choose a nondetachable connection.

According to the invention, the joining element may have a coding, preferably a colour coding.

According to the invention, the joining element may be formed from a plastic, composite material, a fibre material, a fibre composite material and/or preferably from metal.

According to the invention, the support device may be formed from metal, composite material, a fibre material, a composite fibre material and/or preferably from plastic.

According to the invention, the contact support or the contact supports may be formed from composite material, a fibre material, a fibre composite material and/or preferably from plastic.

According to the invention, the contact support may have a coding. For example, the contact support may have an A-coding, B-coding, D-coding, W-coding and/or colour coding or no coding.

According to the invention, the installation height can be adjustable by provision of different contact supports and/or joining elements.

According to the invention, the contact support may have a connecting element, a coupling element and/or an optical fibre connecting element. Combinations and/or alternatives known or obvious to the person skilled in the art are conceivable.

The invention also comprises a support device for a distributor system according to the invention, for example a support device having a holding device for a holding section of a contact support, the support device and the holding device(s) preferably being formed as stated above.

The invention also comprises a contact support or a support device for a distributor system according to the invention, for example a contact support having a holding section for holding in a holding device of a support device, the contact support and the holding section being formed as stated above.

According to one embodiment of the invention, a method for producing a distributor system comprising a support device and a plurality of contact supports which are arranged in the support device comprises the following steps:

provision of a support device having at least one holding device, provision of at least one contact support having a holding section fitting into the holding device, and insertion of the contact support into the holding device.

According to the invention, the contact support can be inserted into the holding device with a joining element. The method can be designed in such a way that a distributor system according to the invention, as stated above, is provided.

BRIEF DESCRIPTION OF THE DRAWINGS

The invention is described in more detail below with reference to the embodiments shown in the figures.

Figure 1:
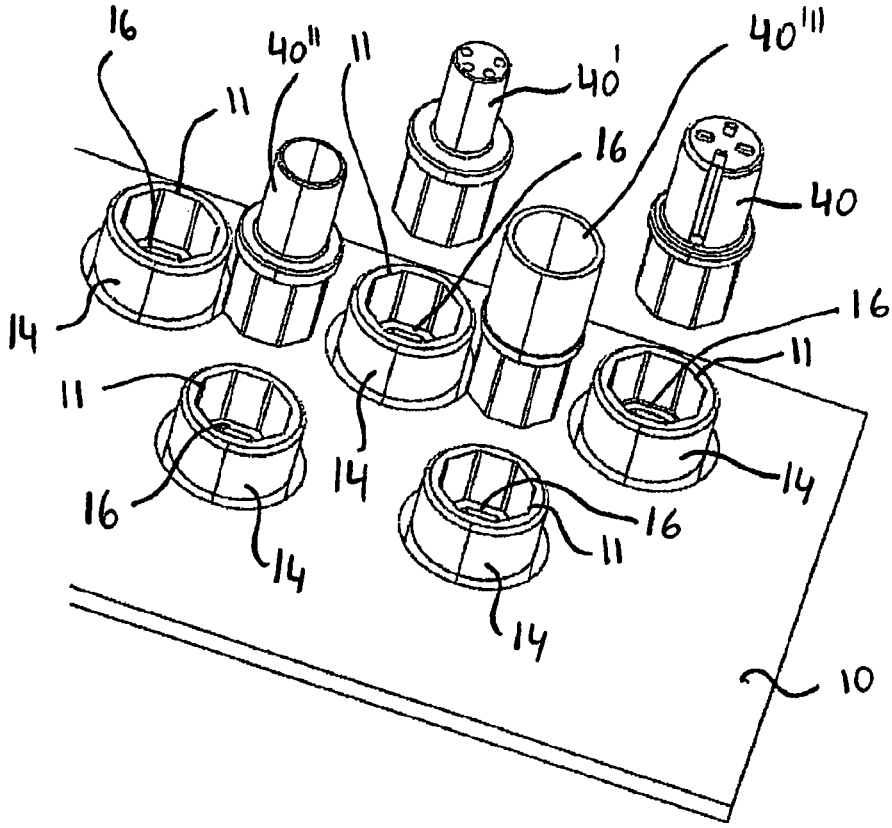
FIG. 1 shows a perspective exploded partial view of a support device having a plurality of variants of contact supports which can be arranged therein for a distributor system according to the invention.

The following reference numerals are used in the description of the embodiments:

10 Support device
11, 11A Holding device (octagonal)
11B Holding device (heptagonal)
11C Holding device (hexagonal)
11D Holding device (pentagonal)
11E Holding device (tetragonal)
11F Holding device (triangular)
11G Holding device (round, eight recesses)
11HA Holding device (round, eight projections)
11HB Holding device (round, one projection)
11HC Holding device (round, two projections)
11HD Holding device (round, four projections)
11HE Holding device (round, six projections)

11IA Holding device (round, eight recesses, asymmetrically distributed)
11IB Holding device (round, eight recesses, symmetrical in pairs, asymmetrically distributed)
11JA Holding device (round, one projection)
11JB Holding device (round, two projections)
13G Recess (holding device)
13HA, 13HB,
13HC, 13HD,
13HE Projection (holding device)
13IA, 13IB Recess (holding device)
13JA, 13JB Projection (holding device)
14 Cylinder wall
15 Projection (support device)
16 Step
20 Cover plate
30 Joining element
31 Bead
32 Groove
33 Cylinder wall
34 Offset
35 Cylinder section
36 Spacer
37 Cylinder section
40 Contact support
40' Contact support
40" Contact support
40'" Contact support
41, 41A, 41',
41", 41'" Holding section (octagonal)
41B Holding section (triangular)
41C Holding section (rectangular)
41GA Holding section (round, eight projections)
41GB Holding section (round, one projection)
41GC Holding section (round, two projections)
41GD Holding section (round, four projections)
41GE Holding section (round, six projections)
41H Holding section (round, eight recesses)
41IA Holding section (round, one projection)
41IB Holding section (round, two projections)
41JA Holding section (round, eight recesses, asymmetrically distributed)
41JB Holding section (round, eight recesses, symmetrical in pairs, asymmetrically distributed)
42A, 42GA,
42H Marking
43GA, 43GB Projection (holding section)
43GC, 43JD Projection (holding section)
43GE Projection (holding section)
43H Recess (holding section)
43IA, 43IB Projection (holding section)
43JA, 43JB Recess (holding section)
44 Connecting section
45 Pin receptacle
46 Coding groove

DETAILED DESCRIPTION OF THE INVENTION

Figure 2:
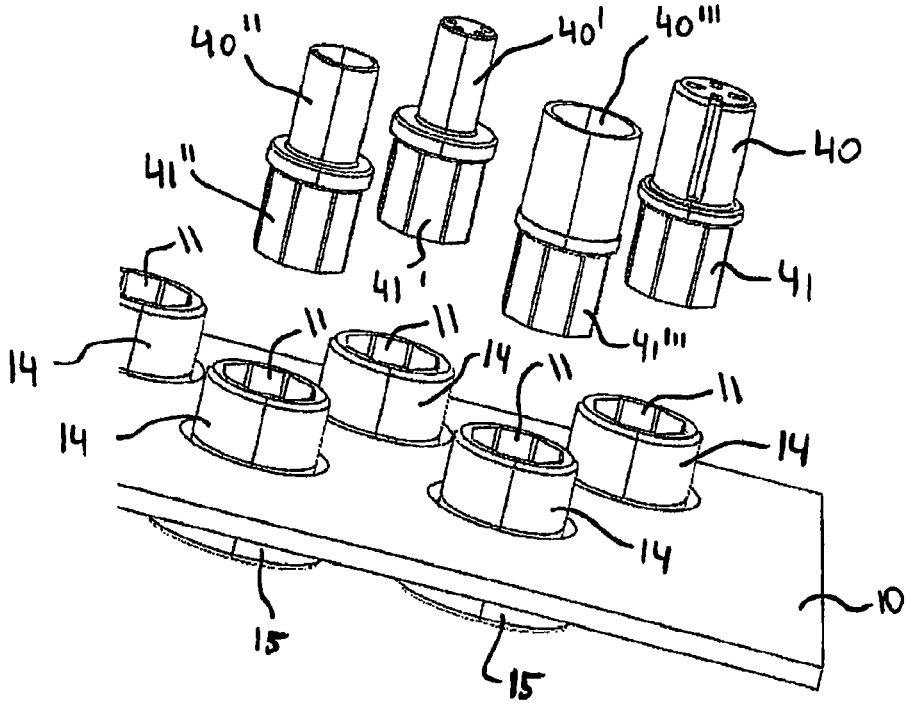
FIG. 2 shows a perspective exploded partial view corresponding to FIG. 1, from another angle.

FIGS. 1 and 2 show perspective exploded partial views of a support device 10 having a plurality of variants of contact supports 40, 40', 40", 40'" which can be arranged therein for a distributor system according to the invention. The support device 10 has a plurality of identically formed holding devices 11 having an octagonal cross-section or an octagonal inner contour. In each case a cylinder wall 14 of the holding device 11 projects upwards above the support device 10. A projection 15 (FIG. 2) projects downwards. FIG. 1 shows a step 16 which serves as a stop during the mounting of the contact supports 40, 40', 40", 40'".

The contact supports 40, 40', 40", 40'" each have a holding section 41, 41', 41", 41'" with which they can be arranged in the holding device 11.

The contact supports 40, 40', 40", 40'" shown relate to different embodiments of contact supports which are known to the person skilled in the art and can be used, for example, according to the invention. For a more detailed description, reference is made to the knowledge of the person skilled in the art. It is possible to arrange identical or different contact supports in a distributor system of the invention.

Figure 3:
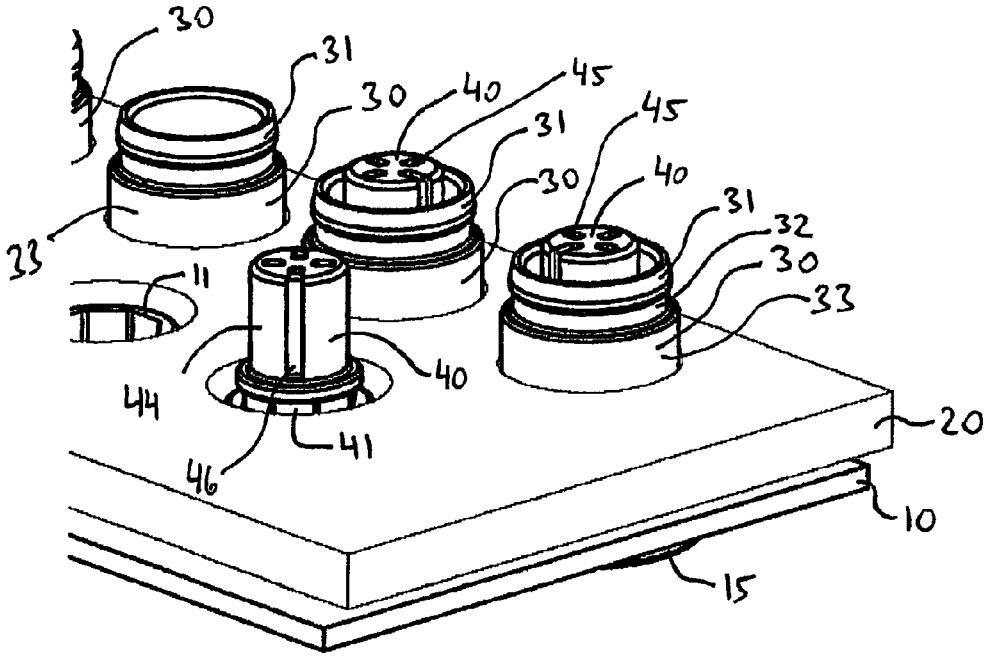
FIG. 3 shows a perspective partial view of a distributor system according to the invention, in which some joining elements and contact supports are omitted from the diagram for clearly illustrating the design.
Figure 4:
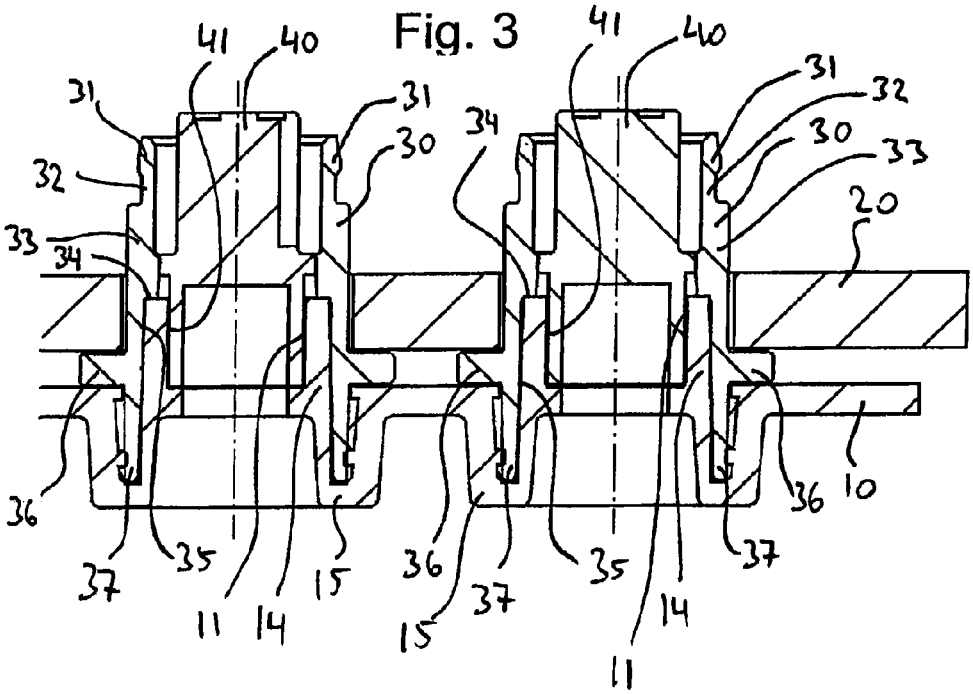
FIG. 4 shows a partial sectional view of a distributor system according to the invention.

FIG. 3 shows a perspective partial view of a distributor system according to the invention, in which some joining elements 30 and contact supports 40 are omitted from the diagram for clearly illustrating the design. FIG. 4 shows an exemplary schematical partial sectional view of a distributor system according to the invention, which distributor system substantially corresponds to the diagram in FIG. 3.

In addition to the diagrams of FIGS. 1 and 2, a cover plate 20 which closes the distributor system on top is shown. Joining elements 30 are provided around the contact supports 40. The joining elements 30 each have, as a termination of a cylinder wall, a bead 31 and a groove 32 which serve in a known manner for connection of a quick-release connection. An offset 34 which rests on the top of the holding device 11, as can be seen in FIG. 4, is provided on the inside of the cylinder wall 33. A cylinder section 35 is provided in the direction of the projection 15. A spacer 36 which defines the distance of the cover plate 20 from the support device 10 (the support element) extends laterally from the cylinder section 35. A further cylinder section 37 extends from the spacer 36 into the projection 15, the cylinder section 37 engaging a recess which surrounds the holding device 11.

The contact supports are designed in a known manner above the holding section and have a connecting section 44, a plurality of pin receptacles 45 and a coding groove 46. Of course, other contact support arrangements known to the person skilled in the art may be used, for example those shown in FIGS. 1 and 2.

Figure 5A:
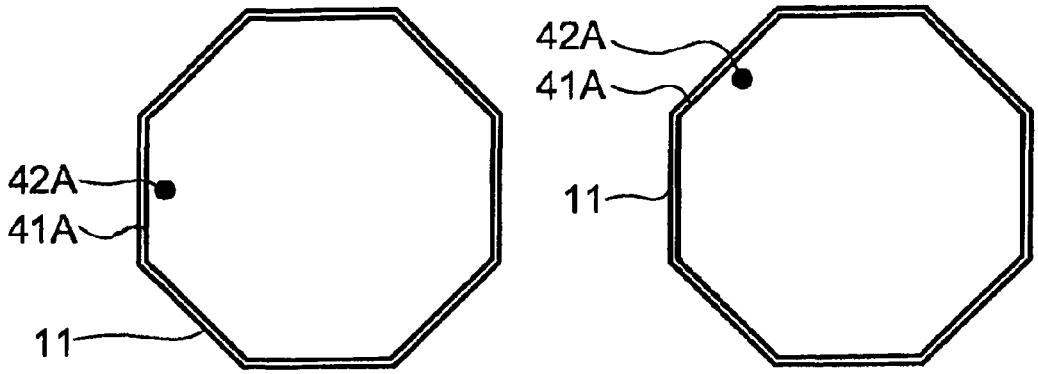
FIGS. 5A, 5B and 5C each show schematic diagrams of the inner contour of a holding device of a support device and matching outer contours of a holding section of a contact support for distributor systems according to the invention in two different exemplary orientations in each case.
Figure 5B:
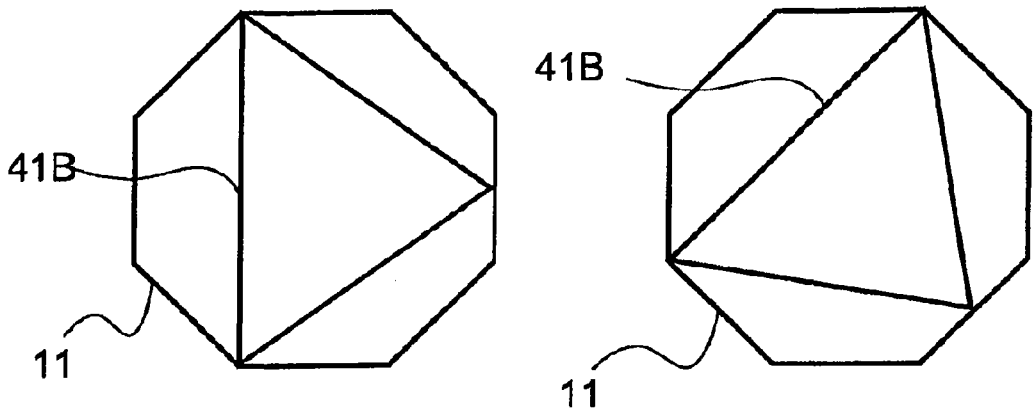
Figure 5C:
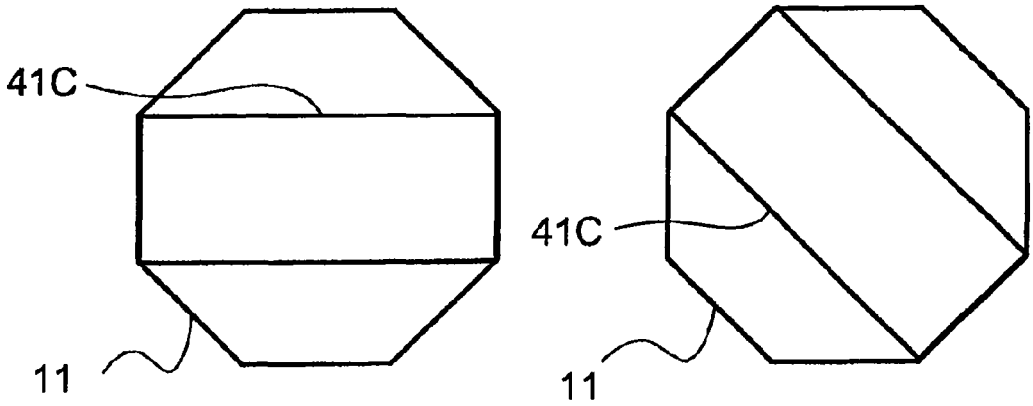
Figure 6A:
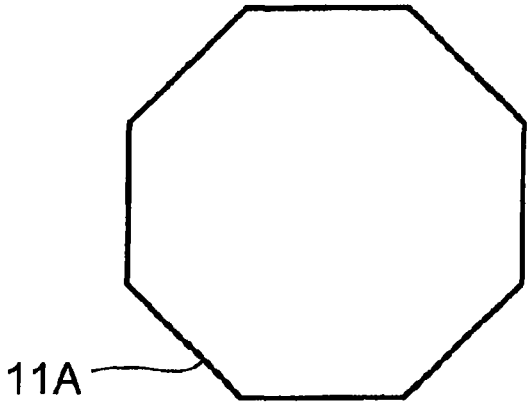
FIGS. 6A, 6B, 6C, 6D, 6E and 6F each show a schematic diagram of a possible form of the inner contour of a holding device of a support device for distributor systems according to the invention.
Figure 6B:
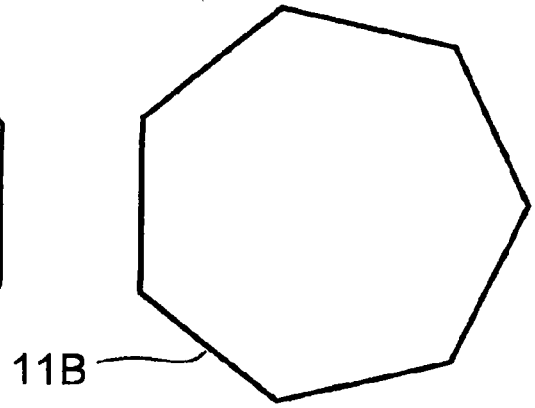
Figure 6C:
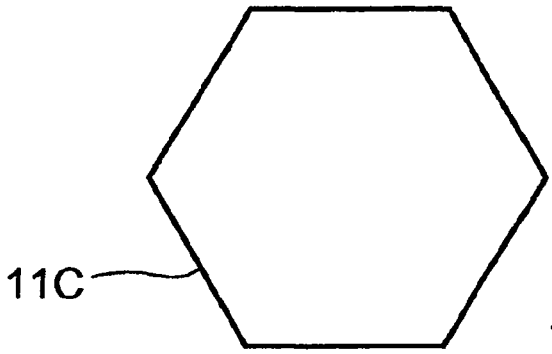
Figure 6D:
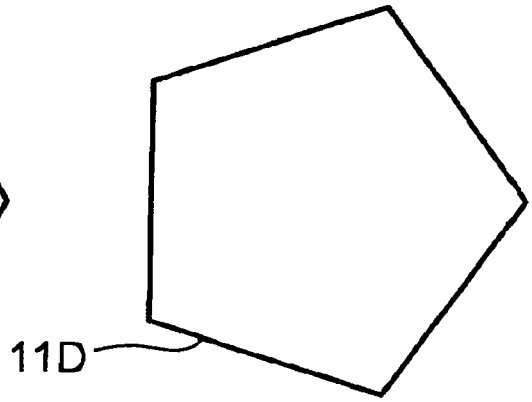
Figure 6E:
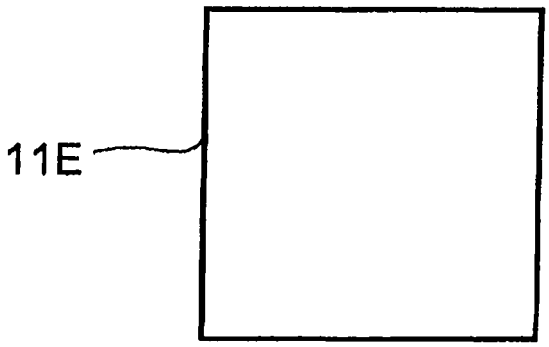
Figure 6F:
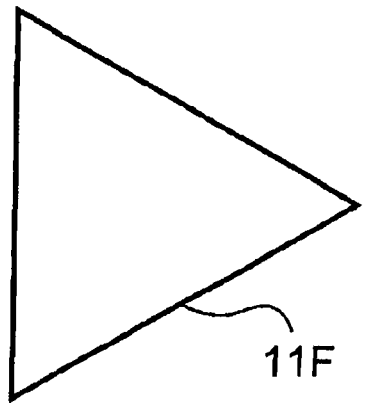

FIGS. 5A, 5B and 5C each show schematic diagrams of the inner contour of a holding device of a support device and matching outer contours of a holding section of a contact support for distributor systems according to the invention in two different exemplary orientations in each case. Here, the inner contour of the holding device 11 is, for example, octagonal. FIG. 5B shows two possible orientations of a holding section 41B having a triangular outer contour. There are likewise eight possible orientations. The holding section 41C shown in FIG. 5C has a rectangular outer contour. There are likewise eight possible orientations.

FIGS. 6A, 6B, 6C, 6D, 6E and 6F each show a schematic diagram of a possible form of the inner contour of a holding device 11A (octagonal), 11B (heptagonal), 11C (hexagonal), 11D (pentagonal), 11E (tetragonal) and 11F (triangular), respectively, of a support device 10 for distributor systems according to the invention.

Figure 7A:
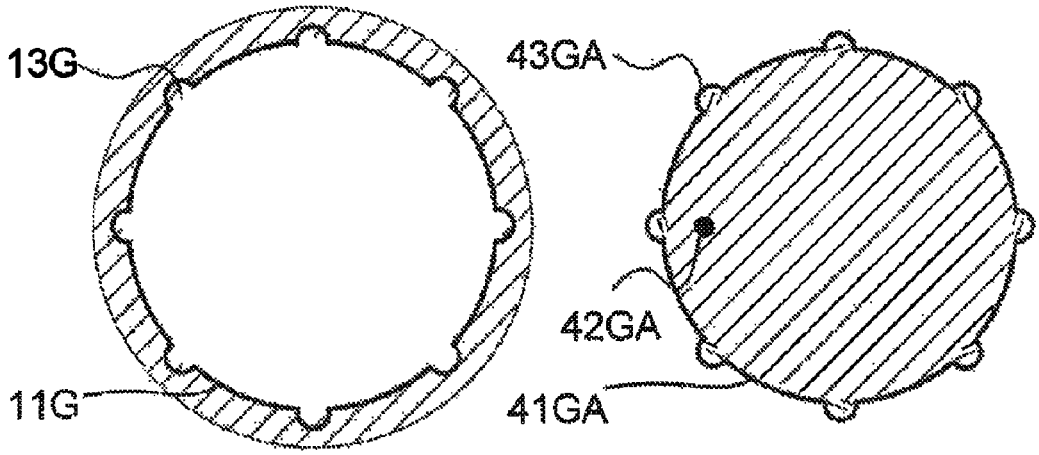
FIG. 7A shows a schematic diagram of an inner contour of a holding device of a support device and a matching outer contour of a holding section of a contact support for distributor systems according to the invention.

FIG. 7A shows a schematic diagram of an inner contour of a holding device 11G of a support device 10 and of a matching outer contour of a holding section 41GA of a contact support 40 for distributor systems according to the invention. The inner contour is substantially circular and the holding device 11G has eight recesses 13G. The outer contour is likewise substantially circular and has eight projections 43GA corresponding to the recesses. The marking 42GA indicates the orientation. There are eight possible orientations.

Figure 7B:
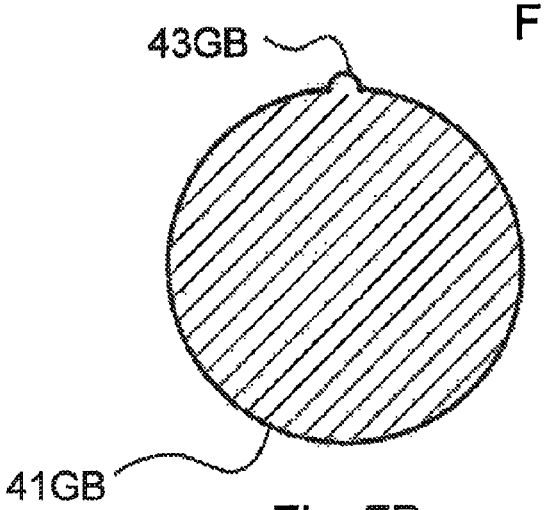
FIGS. 7B, 7C, 7D and 7E each show a possible variant of an outer contour matching the inner contour shown in FIG. 7A.
Figure 7C:
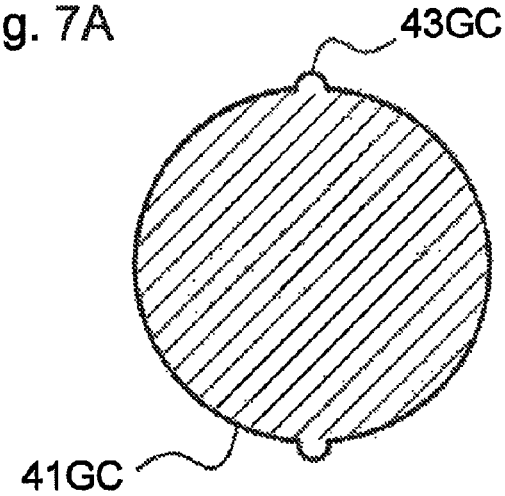
Figure 7D:
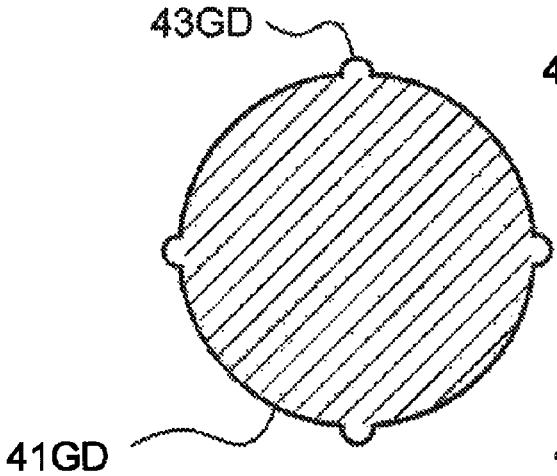
Figure 7E:
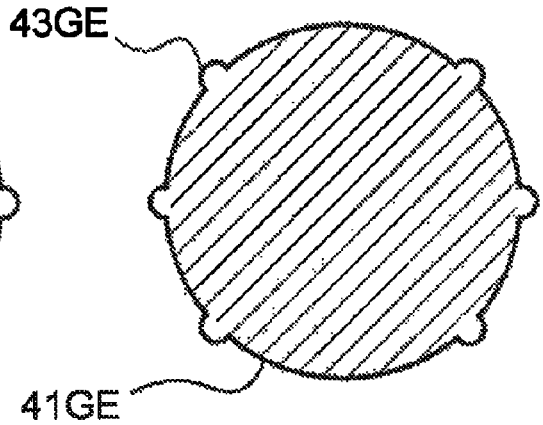

FIGS. 7B (holding section 41GB having one projection 43GB), 7C (holding section 41GC having two projections 43GC), 7D (holding section 41GD having four projections 43GD) and 7E (holding section 41GE having six projections 43GE) each show a possible variant of an outer contour matching the inner contour shown in FIG. 7A. There are in each case eight possible orientations. Variants (shape, size or number of projections or recesses, etc) are of course conceivable.

Figure 8A:
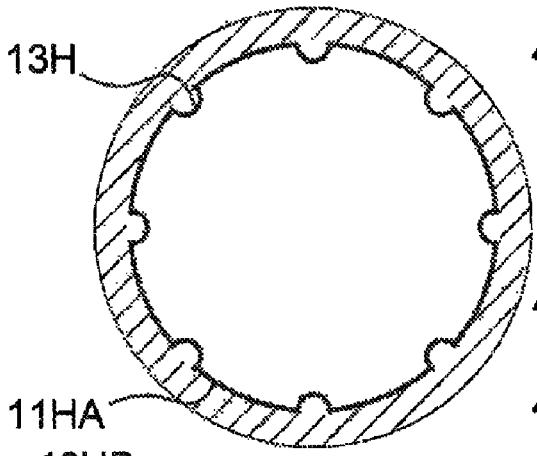
FIG. 8A shows a schematic diagram of an inner contour of a holding device of a support device and a matching outer contour of a holding section of a contact support for distributor systems according to the invention.
Figure 8A:
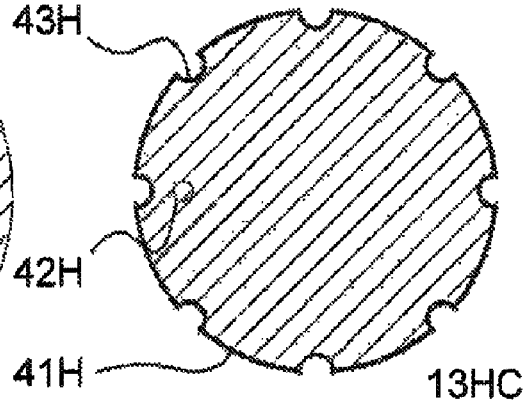

FIG. 8A shows a schematic diagram of an inner contour of a holding device 11HA of a support device 10 and of a matching outer contour of a holding section 41H of a contact support 40 for distributor systems according to the invention. The inner contour is substantially circular and the holding device 11HA has eight projections 13HA. The outer contour is likewise substantially circular and has eight recesses 43H corresponding to the projections. The marking 42H indicates the orientation. There are eight possible orientations.

Figure 8B:
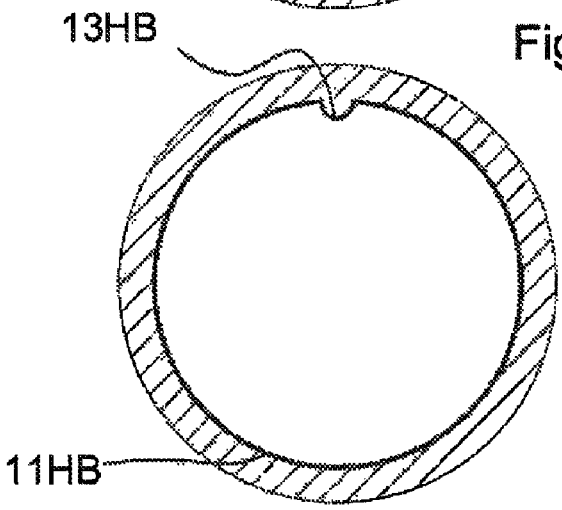
FIGS. 8B, 8C, 8D and 8E each show a possible variant of an inner contour matching the outer contour shown in FIG. 8A.
Figure 8C:
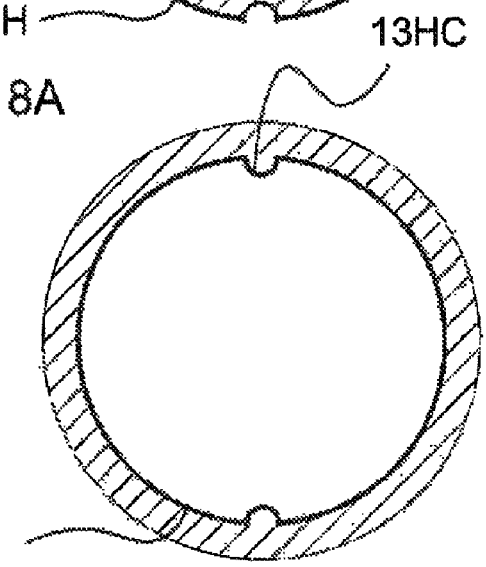
Figure 8D:
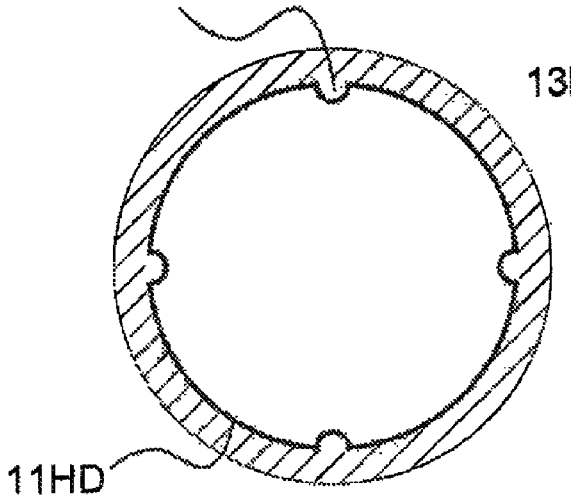
Figure 8E:
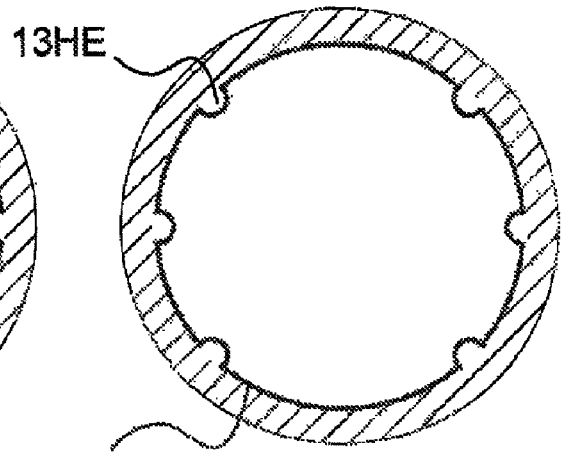

FIGS. 8B (holding device 11HB having one projection 13HB), 8C (holding device 11HC having two projections 13HC), 8D (holding device 11HD having four projections 13HD) and 8E (holding device 11HE having six projections 13HE) each show a possible variant of an inner contour matching the outer contour shown in FIG. 8A. There are in each case eight possible orientations. Variants (shape, size or number of projections or recesses, etc) are of course conceivable.

FIGS. 9A, 9B, 10A and 10B each show a schematic diagram of an inner contour of a holding device 11IA, 11IB, 11JA and 11JB, respectively, of a support device and of a matching outer contour of a holding section 41IA, 41IB, 41JA and 41JB, respectively, of a contact support for distributor systems according to the invention. Variants (shape, size or number of projections or recesses, etc) are of course conceivable.

Figure 9A:
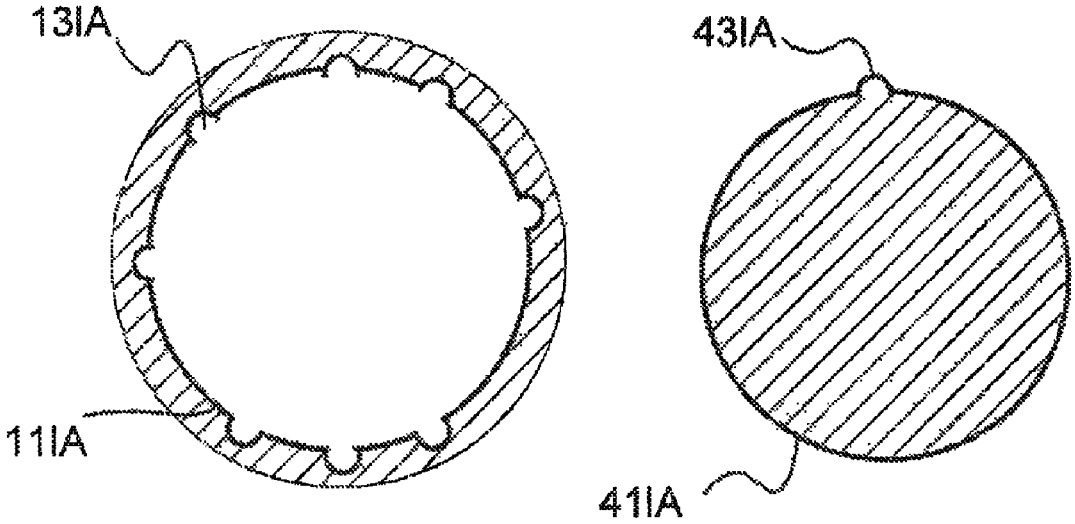
FIGS. 9A, 9B, 10A and 10B each show a schematic diagram of an inner contour of a holding device of a support device and a matching outer contour of a holding section of a contact support for distributor systems according to the invention.

In FIG. 9A, the holding device 11IA has eight recesses 13IA distributed asymmetrically on a substantially circular inner contour. The corresponding outer contour of the holding section 41IA has a projection 43IA which can be arranged in eight possible orientations.

Figure 9B:
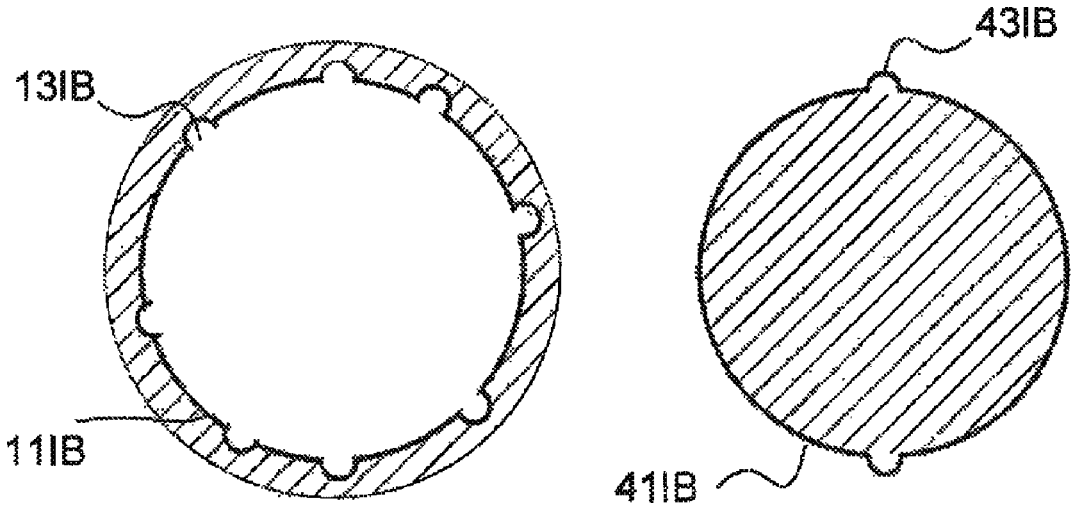

In FIG. 9B, the holding device 11IB has eight recesses 13IB which in each case can be combined in pairs (symmetrical or asymmetrical groups of more than two recesses are conceivable) in an arrangement offset 180° (other arbitrary angles are conceivable) relative to one another and are distributed asymmetrically on a substantially circular inner contour. The corresponding outer contour of the holding section 41IB has two corresponding projections 43IB. There are eight possible orientations.

Figure 10A:
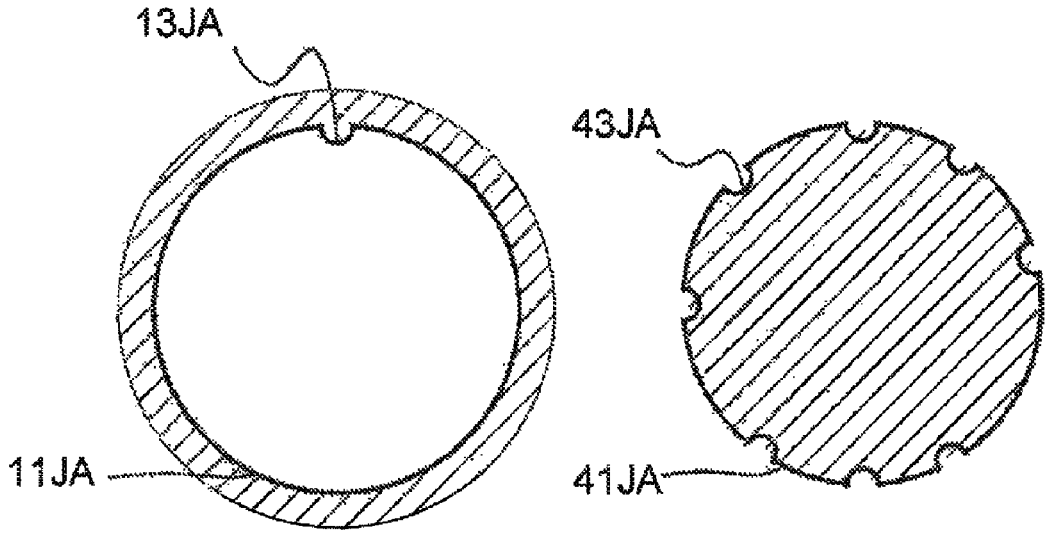

In FIG. 10A, the holding section 41JA has eight recesses 43JA distributed asymmetrically on a substantially circular outer contour. The corresponding inner contour of the holding device 11JA has a projection 13JA which can be arranged in eight possible orientations.

Figure 10B:
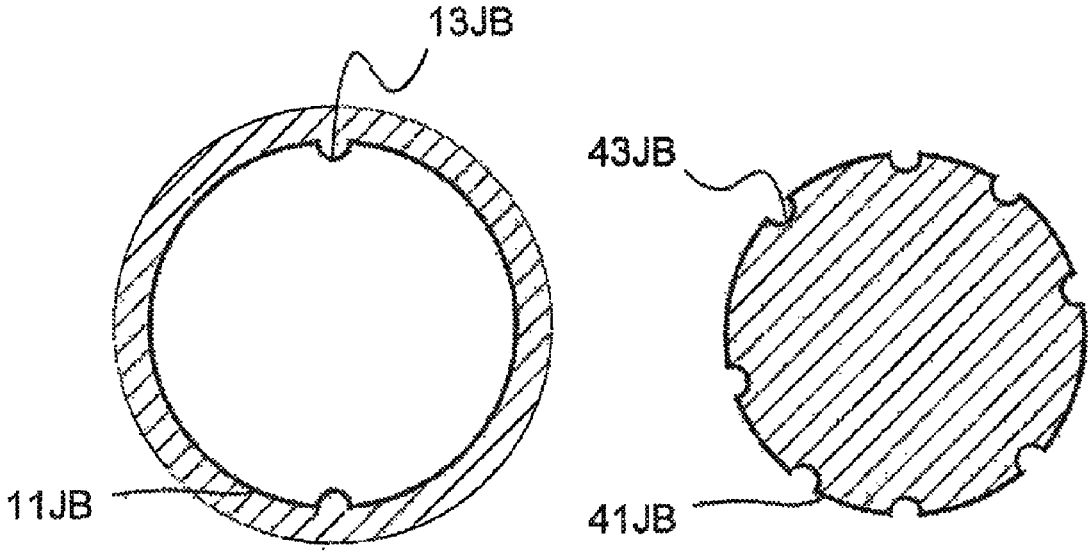

In FIG. 10B, the holding section 41JB has eight recesses 43JB which in each case can be combined in pairs (symmetrical or asymmetrical groups of more than two recesses are conceivable) in an arrangement offset 180° (other arbitrary angles are conceivable) relative to one another and are distributed asymmetrically on a substantially circular outer contour. The corresponding inner contour of the holding device 11JB has two corresponding projections 13JB. There are eight possible orientations.

It is clear that alternatives obvious to the person skilled in the art on studying the documents and equivalent solutions should also be within the scope of protection of the present application.

What is claimed is:

1. A distributor system comprising:

a distributor housing with a support board comprising at least two holding devices integrally formed in the support board; and at least two contact supports, a first contact support of the at least two contact supports being coupled to a first holding device of the at least two holding devices, and a second contact support of the at least two contact supports being coupled to a second holding device of the at least two holding devices, the first contact support of the at least two contact supports comprising a plurality of distinct contacts and a holding section fitting into the first holding device of the at least two holding devices of the support board, and the second contact support of the at least two contact supports comprising a plurality of distinct contacts and a holding section fitting into the second holding device of the at least two holding devices of the support board.

2. The distributor system according to claim 1, wherein the first holding device and the second holding device are identically formed.

3. The distributor system according to claim 1, wherein the first holding device and the second holding device are formed so as to be at least partly different.

4. The distributor system according to claim 1, wherein a cross-section of the first holding device of the at least two holding devices is rotationally symmetrical.

5. The distributor system according to claim 1, wherein the first holding device of the at least two holding devices has a cross-section of a regular polygon, comprising one octagon, heptagon, hexagon, pentagon, tetragon or triangle.

6. The distributor system according to claim 1, wherein the holding section of the first contact support has a shape which is formed so that the holding section of the first contact support can be arranged in different orientations when fit into the first holding device of the at least two holding devices.

7. The distributor system according to claim 1, wherein the holding section of the first contact support has a cross-section which substantially corresponds to the cross-section of the first holding device of the at least two holding devices.

8. The distributor system according to claim 1, wherein a cross-section of the first holding device of the at least two holding devices is asymmetrical.

9. The distributor system according to claim 1, wherein a cross-section of the first holding device of the at least two holding devices is substantially circular, and wherein the first holding device of the at least two holding devices has recesses distributed over the circumference.

10. The distributor system according to claim 9, wherein the holding section of the first contact support has at least one projection which fits into the recesses of the first holding device of the at least two holding devices to facilitate avoiding rotation of the first holding section when fit into the first holding device.

11. The distributor system according to claim 10, wherein the number of projections corresponds to the number of recesses, and the projections and recesses are arranged over the circumference with a uniform distribution.

12. The distributor system according to claim 10, wherein the number of projections is smaller than the number of recesses.

13. The distributor system according to claim 12, wherein the recesses are asymmetrically distributed over the circumference in such a way that the projection or the projections can be arranged in different orientations in the recesses.

14. The distributor system according to claim 9, wherein the holding section of the first contact support has at least a plurality of projections which fit into the recesses of the first holding device of the at least two holding devices.

15. The distributor system according to claim 1, wherein a cross-section of the first holding device of the at least two holding devices is substantially circular, and wherein the first holding device of the at least two holding devices has at least one projection.

16. The distributor system according to claim 15, wherein the holding section of the first contact support has one or more recesses distributed over the circumference, the at least one projection of the first holding device fitting into the one or more recesses of the holding section of the first contact support to facilitate avoiding rotation of the holding section of the first contact support when fit into the first holding device.

17. The distributor system according to claim 16, wherein the first holding device of the at least two holding devices has at least a plurality of projections which fit into the recesses of the holding section of the first contact support.

18. The distributor system according to claim 16, wherein the number of projections corresponds to the number of recesses, and the projections and recesses are arranged over the circumference with a uniform distribution.

19. The distributor system according to claim 16, wherein the number of projections is smaller than the number of recesses.

20. The distributor system according to claim 19, wherein the recesses are distributed asymmetrically over the circumference in such a way that the projection or the projections can be arranged in different orientations in the recesses.

21. The distributor system according to claim 1, wherein the first holding device of the at least two holding devices forms a press-fit with the holding section of the first contact support.

22. The distributor system according to claim 1, wherein the first holding device of the at least two holding devices is welded or screwed to, inserted into, interlocked with or adhesively bonded to the holding section of the first contact support or is connected to said holding section of the first contact support by another joining method.

23. The distributor system according to claim 1, wherein a joining element which is arranged around the circumference of the first contact support is further provided.

24. The distributor system according to claim 23, wherein the joining element secures the first contact support in the first holding device of the at least two holding devices.

25. The distributor system according to claim 23, wherein the joining element seals the first contact support in the first holding device of the at least two holding devices.

26. The distributor system according to claim 23, wherein the joining element is welded, screwed, inserted, interlocked, adhesively bonded or fastened by another joining method.

27. The distributor system according to claim 23, wherein the joining element has a connecting section for connection of a plug which can be plugged onto the first contact support.

28. The distributor system according to claim 27, wherein the connecting section is designed for a thread connection, a bayonet connection, a push/pull connection and/or a fast-release connection, which is detachable or nondetachable.

29. The distributor system according to claim 23, wherein the joining element has a coding, preferably a colour coding.

30. The distributor system according to claim 23, wherein the joining element is formed from a plastic, composite material, a fibre material, a fibre composite material or from metal.

31. The distributor system according to claim 1, wherein the support board is formed from metal, composite material, a fibre material, a fibre composite material and/or preferably from plastic.

32. The distributor system according to claim 1, wherein the at least two contact supports are formed from composite material, a fibre material, a fibre composite material and/or preferably from plastic.

33. The distributor system according to claim 1, wherein the first contact support has a coding.

34. The distributor system according to claim 1, wherein the first contact support has an A-coding, B-coding, D-coding, W-coding and/or colour coding or no coding.

35. The distributor system according to claim 1, wherein installation height can be adjusted by employing different contact supports and/or joining elements.

36. The distributor system according to claim 1, wherein the first contact support has at least one of a connector, a coupling element or an optical fibre connecting element.

37. A method for the production of a distributor system, the method comprising:

providing a distributor housing with a support board comprising a at least two holding devices integrally formed in the support board;

providing at least two contact supports, a first contact support of the at least two contact supports comprising a plurality of distinct contacts and a holding section fitting into a first holding device of the at least two holding devices, and a second contact support of the at least two contact supports comprising a plurality of distinct contact and a holding section fitting into a second holding device of the at least two holding devices; and coupling the at least two contact supports to the support board by inserting the first contact support of the at least two contact supports into the first holding device of the at least two holding devices and inserting the second contact support of the at least two contact supports into the second holding device of the at least two holding devices.

38. The method according to claim 37, wherein the inserting comprises inserting the first contact support into the first holding device and inserting the second contact support into the second holding device, and wherein the first contact support is secured in the first holding device via a first joining element, and the second contact support is secured in the second holding device via a second joining element.

39. The method according to claim 37, wherein upon insertion of the first contact support into the first holding device, at least one of a gas-tight or a water-tight connection is formed, and wherein upon insertion of the second contact support into the second holding device, at least one of a gas-tight or a water-tight connection is formed.

40. A distributor system comprising:

a distributor housing with a support board, the support board comprising at least two holding devices integrally formed in the support board;

at least two contact supports, a first contact support of the at least two contact supports comprising a holding section for mating the first contact support in a first holding device of the at least two holding devices, and a second contact support of the at least two contact supports comprising a holding section for mating the second contact support in a second holding device of the at least two holding devices; and at least two joining elements, a first joining element of the at least two joining elements surrounding the first contact support of the at least two contact supports and facilitating securing the first contact support in the first holding device of the at least two holding devices, and a second joining element of the at least two joining elements surrounding the second contact support of the at least two contact supports and facilitating securing the second contact support in the second holding device of the at least two holding devices.

41. The distributor system of claim 40, wherein the first holding device of the at least two holding devices comprises a first projection extending in a first direction away from a first surface of the support board and a second projection extending in a second direction away from a second surface of the support board.

42. The distributor system of claim 41, wherein the second projection forms a channel into which the first joining element of the at least two joining elements extends, and wherein the first joining element engages with the second projection to secure the first joining element to the support board.

43. The distributor system of claim 41, wherein the first joining element of the at least two joining elements comprises an offset resting on the first projection of the first holding device.

44. The distributor system of claim 40, wherein the first joining element comprises a spacer engaging with at least one cover plate for closing the distributor system, and spacing the at least one cover plate away from the support board, and wherein the second joining element comprises a spacer engaging with the at least one cover plate for closing the distributor system, and spacing the at least one cover plate away from the support board.

* * * * *